US005442842A

United States Patent [19]

Nielsen et al.

[11] Patent Number: 5,442,842

[45] Date of Patent: Aug. 22, 1995

[54] APPARATUS FOR GUIDING LONGITUDINAL TRAVEL OF TUBULAR FABRIC

[75] Inventors: Arne Nielsen; Phillip D. McCartney, both of Oak Ridge; Donnie J. Thompson; Majid Moghaddassi, both of Greensboro, all of N.C.

[73] Assignee: Guilford Mills, Inc., Greensboro, N.C.

[21] Appl. No.: 142,173

[22] Filed: Oct. 25, 1993

[51] Int. Cl.[6] ..... D06C 5/00

[52] U.S. Cl. ..... 26/80; 26/85

[58] Field of Search ..... 26/80, 83, 84, 85, 51, 26/51.3, 51.4, 51.5; 226/10, 15, 17–19, 20, 45

[56] References Cited

U.S. PATENT DOCUMENTS

| | | | |
|---|---|---|---|
| 2,238,560 | 4/1941 | Fleisher | 26/29 |
| 2,350,071 | 5/1944 | Shields | 26/55 |
| 2,503,705 | 4/1950 | Blumenbaum et al. | 26/83 |
| 2,591,903 | 4/1952 | Yost | 26/55 |
| 3,337,107 | 8/1967 | Catallo et al. | 226/197 |
| 3,501,818 | 3/1970 | Heitkamp | 26/85 |
| 3,616,502 | 11/1971 | Aronoff | 26/85 |
| 4,011,128 | 3/1977 | Suzuki | 26/85 |
| 4,266,983 | 5/1981 | Laszlo et al. | 26/85 |
| 4,517,712 | 5/1985 | Diggle, Jr. et al. | 26/74 |
| 4,843,669 | 7/1989 | Koch et al. | 26/74 |
| 5,271,131 | 12/1993 | Jacumin | 26/80 |

FOREIGN PATENT DOCUMENTS

| | | | |
|---|---|---|---|
| 2926442 | 1/1981 | Germany | 26/80 |
| 735693 | 5/1980 | U.S.S.R. | 26/80 |

*Primary Examiner*—Andrew M. Falik
*Assistant Examiner*—Amy B. Vanatta
*Attorney, Agent, or Firm*—Shefte, Pinckney & Sawyer

[57] ABSTRACT

Tubular textile fabric is guided during longitudinal travel substantially without circumferential torque or twisting by a guide apparatus having a series of guide rings which open the tubular fabric into circular form, a drive ring affixed co-axially to the guide rings and mounted rotationally on the apparatus frame, and a drive motor connected to the drive ring through an endless drive belt for incremental reversible rotation of the drive ring and guide rings as a unit as necessary to counteract fabric torque or twisting. A linear guide stripe or line extends lengthwise along the tubular fabric and is monitored by a photo-optic sensor operable in conjunction with a microprocessor to control incremental and reversing operation of the drive motor as necessary to counteract detected non-linearities in the guide line which indicate the existence of fabric torque or twist.

6 Claims, 2 Drawing Sheets

APPARATUS FOR GUIDING LONGITUDINAL TRAVEL OF TUBULAR FABRIC

BACKGROUND OF THE INVENTION

The present invention relates generally to devices and apparatus for handling the longitudinal travel of tubular textile fabric and, more particularly, to an apparatus by which such fabric may be guided in its longitudinal travel substantially without circumferential torque of the fabric.

Textile fabric as conventionally produced on circular knitting machines is fabricated in a tubular or circular form in general conformity to the diameter of the needle cylinder of the knitting machine. As the knitted fabric is withdrawn from the needle cylinder of the knitting machine, it is flattened into a double thickness to facilitate winding of the fabric into a roll. In doing so, the fabric necessarily becomes creased at diametrically opposed sides of the fabric.

While such creases are accepted as being necessary in the manufacture of tubular fabric, it is highly desirable to avoid the formation of additional creases in the fabric. Thus, in the course of subsequent finishing and handling of a tubular fabric in which the fabric is unrolled for processing and then subsequently rewound, it is very important that the fabric be guided into and through the processing location with the opposing creases traveling substantially linearly and maintained at opposite side edges of the fabric to prevent formation of additional creases and also to facilitate re-winding of the fabric as precisely as possible along the same creases originally formed at the winding section of the knitting machine.

Unfortunately, no reliable mechanism, device, or system is known to exist by which the linear travel of tubular fabric creases can be precisely controlled against the natural tendency of tubular fabric to suffer longitudinal twisting or torquing of the fabric. Accordingly, the only conventional technique available for guiding tubular fabric into a processing station is to have two workers standing at opposite sides of the tubular fabric manually guide the creased edges of the fabric and make fine adjustments as necessary to counteract fabric twisting and torquing. As will be apparent, this procedure is labor intensive, costly, and, in any event, very inexact.

SUMMARY OF THE INVENTION

It is accordingly an object of the present invention to provide a novel apparatus capable of automatically guiding longitudinal travel of a tubular fabric substantially without circumferential torque of the fabric.

Briefly summarized, the present apparatus basically comprises a guide means for opening the tubular fabric into circular form during traveling movement, a frame for supporting the guide means for rotational movement in the direction of the circumference of the traveling fabric, a drive for rotating the guide means, and a means for detecting circumferential torque in the traveling fabric and for actuating controlled operation of the drive opposite to the direction of the detected fabric torque to correct for the torque.

In the preferred embodiment of the present apparatus, the guide means comprises a circular guide ring for disposition interiorly within the traveling fabric co-axially therewith and a pair of circular guide rings for disposition exteriorly of the traveling fabric for co-axially retaining the interior guide ring therebetween. The frame preferably comprises a circular drive ring co-axially affixed to the exterior guide rings and a stationary support for rotatably supporting the drive ring. The drive comprises a drive motor and a drive belt connecting the drive motor to the drive ring.

To facilitate operation of the apparatus of the present invention, a guide line is preferably formed in the tubular fabric to extend lengthwise in parallel relation to its axis. In the preferred embodiment, the torque detecting and controlling means comprises a sensor or other suitable device for monitoring the guide line in the fabric and a controller connected to the drive and operative in response to the sensor to actuate the drive in correspondence to detected non-linearities in the guide line such as result from fabric torque.

DESCRIPTION OF THE PREFERRED EMBODIMENT

Figure 1:
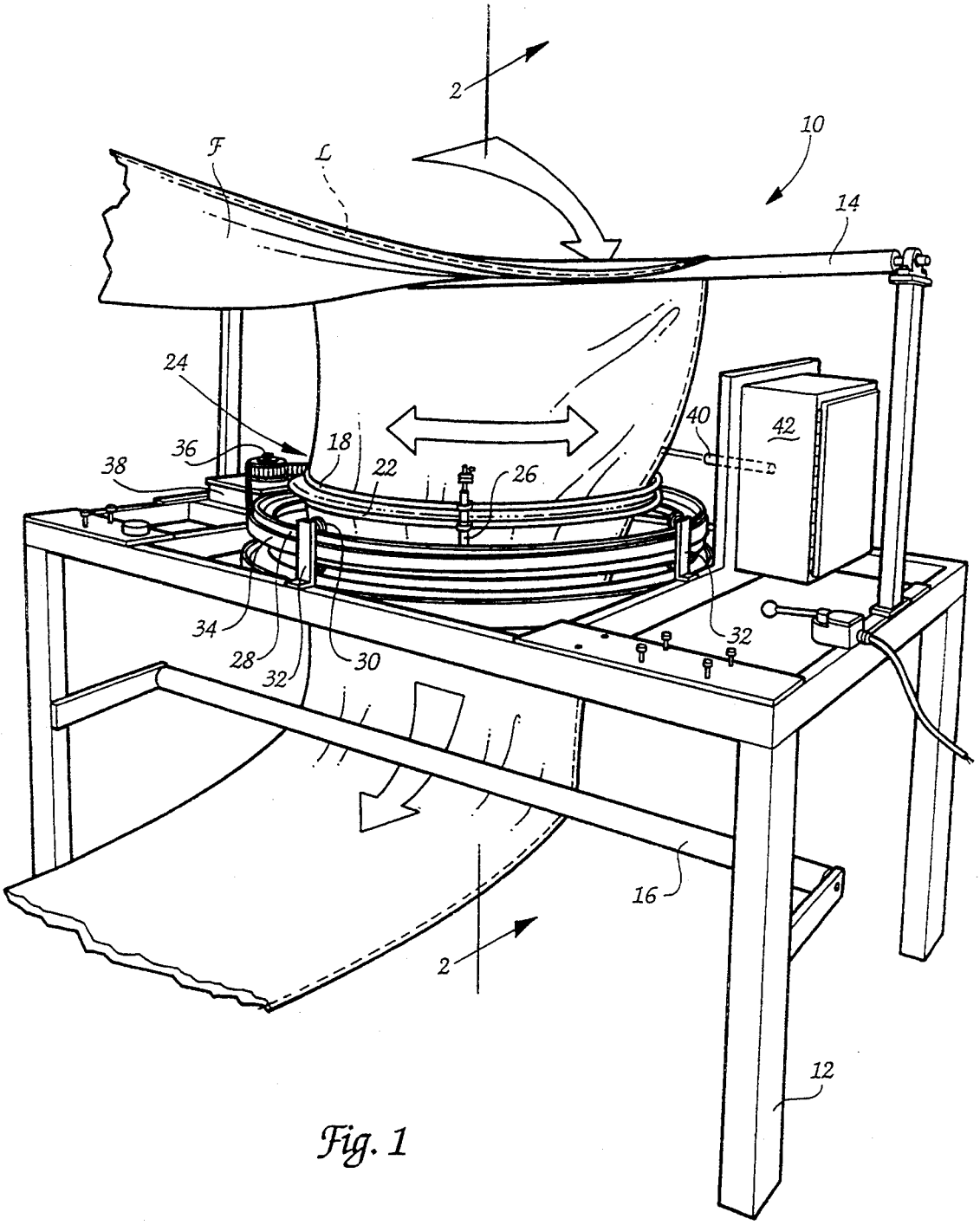
FIG. 1 is a perspective view of a preferred embodiment of the tubular fabric guiding apparatus according to the present invention.
Figure 2:
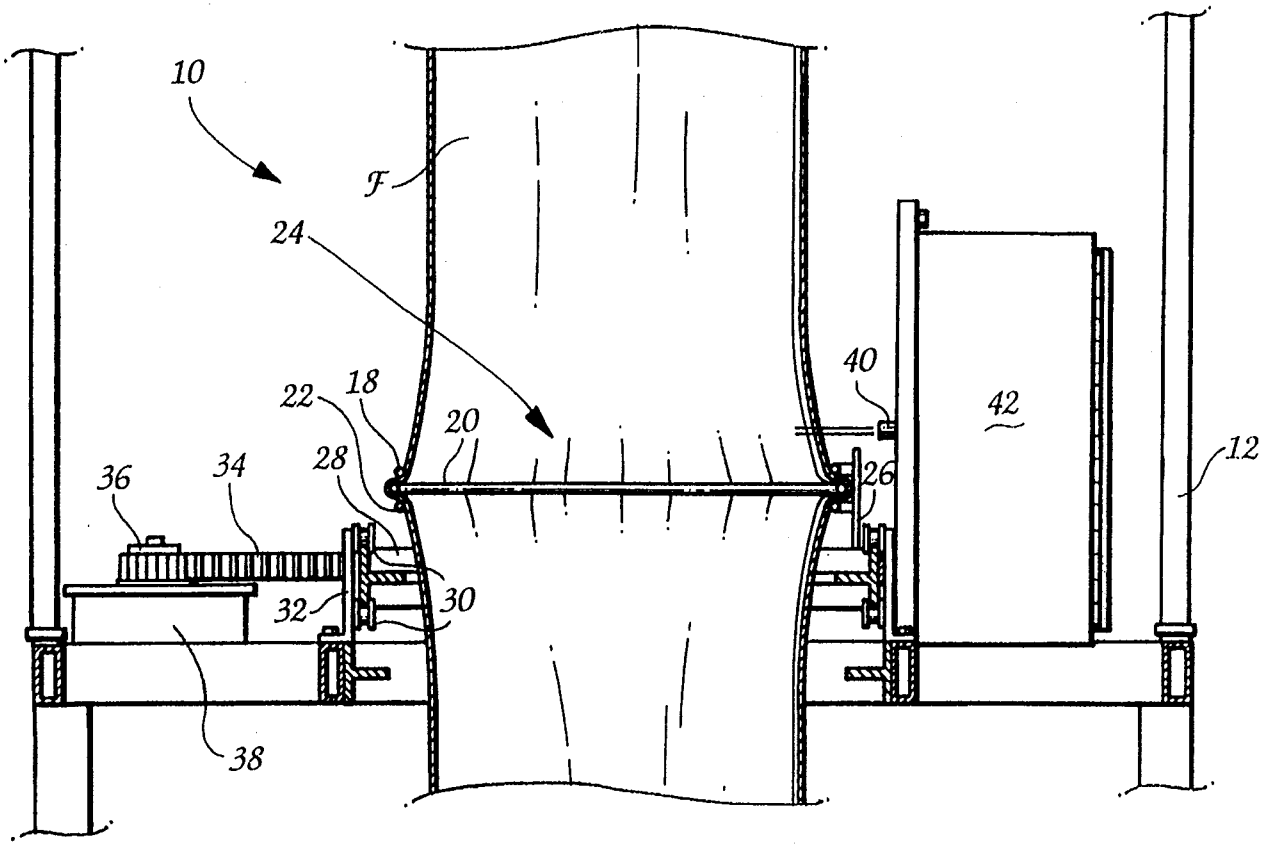
FIG. 2 is a vertical cross-sectional view of the tubular fabric guiding apparatus of FIG. 1, taken along line 2—2 thereof.

Referring now to the accompanying drawings and initially to FIG. 1, the tubular fabric guiding apparatus of the present invention is indicated generally at 10 as preferably embodied for feeding a longitudinally traveling tubular textile fabric F from a supply location (not shown) to a finishing apparatus or station (also not shown).

The guiding apparatus 10 of the present invention is supported in an elevated disposition on an upstanding frame 12, the frame carrying upper and lower guide rollers 14, 16, respectively, above and below the apparatus 10 for diverting the longitudinal path of travel of the fabric F downwardly through the guiding apparatus 10.

The guiding apparatus 10 includes a series of circular guide rings 18, 20, 22 which cooperate to open the tubular fabric F into a substantially circular condition as indicated at 24 in FIG. 1. More particularly, the guide rings 18, 22 are fixed in parallel co-axial relation to one another by a series of circumferentially-spaced connecting brackets 26, with the ring 20 being captured between the guide rings 18, 22 and the brackets 26 but unconnected thereto, whereby the fabric F may be threaded radially inwardly through the center of the guide ring 18, then radially outwardly about the guide ring 20, and then radially inwardly through the center of the guide ring 22.

The brackets 26 connecting the guide rings 18, 22 are also fixed at circumferential spacings to a drive ring 28 co-axial with the guide rings 18, 22, the drive ring 28 being supported on the frame 12 by several pairs of roller bearings 30 mounted on support brackets 32 affixed to the frame 12 at circumferential spacings about the drive ring 28 parallel to and co-axially with the guide rings 18, 20, 22 for rotation thereof as a unit.

An endless drive belt 34 extends circumferentially about the drive ring 28 and about a drive sprocket 36 on the drive shaft of an electric motor 38, preferably an incrementally-operable and reversible motor such as a stepper motor, thereby for driving rotation of the drive ring 28 and the guide rings 18, 20, 22 as a unit selectively in either opposite rotational direction and to any desired angular increment. The roller bearings 30 and the support brackets 32 serve to retain the drive belt 34 in peripheral frictional contact with the drive ring 28.

In accordance with the present invention, and to facilitate operation of the apparatus 10, the fabric F is marked with a line or stripe L extending longitudinally along the entire length of the fabric F in walewise parallel relation to the circular axis of the fabric, thereby providing an optically recognizable guide or reference by which twisting and torque in the fabric may be detected. The stripe or line is formed in the fabric at an early stage in the processing of the fabric subsequent to knitting or even as part of the fabric knitting process or at the take-up winding section of the knitting machine. Preferably, the guide line or stripe L should be formed to coincide as precisely as possible with one longitudinal crease in the fabric when flattened for purposes of winding.

A photo-optic sensor, which may be of any conventional construction or type capable of optically detecting the guide line L in the fabric F, is mounted at one side of a control panel 42 affixed to the frame 12 and is trained directly above the level of the guide rings 18, 20, 22 and at the circumferential location thereabout at which the guide line L and its coinciding crease in the fabric F will pass through the guide rings 18, 20, 22 if traveling precisely linearly and without torque between the guide rollers 14, 16. The control panel 42 houses a microprocessor or other suitable controller to which the photo-optic sensor 40 is connected, the controller being programmed to actuate the drive motor 38 whenever the sensor 40 detects a deviation in linearity of the guide line L, thereby indicating torque or twisting in the fabric F, to drive the drive ring 28 and the guide rings 18, 20, 22 incrementally in the direction opposing the detected non-linearity sufficiently to realign the guide line L and thereby counteract and remove the torque or twist from the fabric.

The sensor 40, the controller 42, and the drive motor 38 operate continuously in the above-described manner as the fabric F travels through the apparatus 10, thereby essentially completely removing torque and twist from the fabric F. As a result, the fabric F is delivered to the processing station immediately downstream of the apparatus 10 in a precisely linear path of travel. An apparatus of the type of the present invention may be utilized at any one or more selected locations along the path of travel of the fabric F during finishing as necessary or desirable to substantially eliminate or at least minimize the formation of creases in the fabric F other than the two diametrically opposed creases created by the initial flattening of the fabric when wound at the knitting machine. In turn, the widthwise area of the fabric F usable by an apparel manufacturer or other user of the fabric F is correspondingly maximized.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for guiding longitudinal travel of tubular fabric substantially without circumferential torque of the fabric, the apparatus comprising guide means for opening the tubular fabric into circular form during traveling movement, frame means for supporting said guide means for rotational movement in the direction of the circumference of the traveling fabric, means for driving rotational movement of said guide means in the direction of the circumference of the traveling fabric, and means for detecting circumferential torque in the traveling fabric and for actuating controlled operation of said driving means opposite to the direction of the detected fabric torque to correct the detected torque.

2. Apparatus for guiding longitudinal travel of tubular fabrics without circumferential torque of the fabric according to claim 1, wherein said guide means comprises a circular guide ring for disposition interiorly of the traveling fabric co-axially therewith and a pair of circular guide rings for disposition exteriorly of the traveling fabric with said interior guide ring therebetween, said exterior guide rings being affixed to said frame means.

3. Apparatus for guiding longitudinal travel of tubular fabric without circumferential torque of the fabric according to claim 2, wherein said frame means comprises a circular drive ring co-axially affixed to said exterior guide rings and a stationary support for rotatably supporting said drive ring.

4. Apparatus for guiding longitudinal travel of tubular fabric without circumferential torque of the fabric according to claim 3, wherein said drive means comprises a drive motor and a drive belt connecting said drive motor to the drive ring.

5. Apparatus for guiding longitudinal travel of tubular fabric without circumferential torque of the fabric according to claim 4, wherein said detecting means comprises means for monitoring a guide line extending lengthwise in the fabric parallel to the fabric's tubular axis and a controller connected to said drive means and operative in respone to said monitoring means for actuating said drive means in correspondence to detected nonlinearities in the guide line.

6. Apparatus for guiding longitudinal travel of tubular fabric without circumferential torque of the fabric according to claim 1, wherein said detecting means comprises means for monitoring a guide line extending lengthwise in the fabric parallel to the fabric's tubular axis and a controller connected to said drive means and operative in response to said monitoring means for actuating said drive means in correspondence to detected nolinearities in the guide line.

* * * * *

UNITED STATES PATENT AND TRADEMARK OFFICE

CERTIFICATE OF CORRECTION

PATENT NO. : 5,442,842

DATED : August 22, 1995

INVENTOR(S) : Arne Nielsen, Phillip D. McCartney, Donnie J. Thompson, Majid Moghaddassi

It is certified that error appears in the above-identified patent and that said Letters Patent is hereby corrected as shown below:

Column 2, line 47, after "circumferentially" delete "-".

Column 2, line 57, delete "co-axial" and insert therefor -- co-axially --.

Column 2, line 66, after "incrementally" delete "-".

Column 4, line 46, delete "the" and insert therefor -- said --.

Column 4, line 53, delete "respone" and insert therefor -- response --.

Column 4, line 64, delete "nolinearities" and insert therefor -- nonlinearities --.

Signed and Sealed this

Second Day of April, 1996

Bruce Lehman

*Attest:*

BRUCE LEHMAN

*Attesting Officer*

*Commissioner of Patents and Trademarks*